US010332468B2

(12) United States Patent
Xu

(10) Patent No.: US 10,332,468 B2
(45) Date of Patent: Jun. 25, 2019

(54) GATE DRIVING CIRCUIT AND DRIVING METHOD THEREOF

(71) Applicant: Shenzhen China Star Optoelectronics Technology Co., Ltd., Shenzhen, Guangdong (CN)

(72) Inventor: Xiangyang Xu, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/568,220

(22) PCT Filed: Aug. 30, 2017

(86) PCT No.: PCT/CN2017/099590

§ 371 (c)(1),
(2) Date: Jul. 11, 2018

(87) PCT Pub. No.: WO2019/015024

PCT Pub. Date: Jan. 24, 2019

(65) Prior Publication Data

US 2019/0019442 A1 Jan. 17, 2019

(30) Foreign Application Priority Data

Aug. 30, 2017 (CN) ..... 201710580980

(51) Int. Cl.
*G09G 3/36* (2006.01)

(52) U.S. Cl.
CPC ... *G09G 3/3677* (2013.01); *G09G 2300/0408* (2013.01); *G09G 2310/0286* (2013.01); *G09G 2310/08* (2013.01)

(58) Field of Classification Search
CPC ..... G09G 3/3674; G09G 3/3677; G09G 2310/0286; G09G 2310/08; G11C 19/28; G11C 19/287
See application file for complete search history.

(56) References Cited

U.S. PATENT DOCUMENTS

| | | | | |
|---|---|---|---|---|
| 9,214,124 | B1 * | 12/2015 | Yu | G09G 3/3648 |
| 9,501,989 | B2 * | 11/2016 | Xiao | G11C 19/28 |
| 10,049,636 | B2 * | 8/2018 | Xu | G09G 3/3677 |
| 10,127,878 | B1 * | 11/2018 | Lv | G11C 19/28 |
| 10,192,505 | B2 * | 1/2019 | Zeng | G02F 1/13 |
| 2018/0211629 | A1 * | 7/2018 | Zeng | G09G 3/3677 |
| 2018/0226035 | A1 * | 8/2018 | Wang | G09G 3/3648 |
| 2018/0293951 | A1 * | 10/2018 | Shi | G09G 3/3677 |

(Continued)

*Primary Examiner* — Patrick O Neill

(57) ABSTRACT

Disclosed is a gate driving circuit and a driving method thereof. The circuit includes: a pull-up control module; a pull-up module; a pull-down module, used to pull down level of an output terminal of the pull-up control module and level of a scanning signal of a current-stage gate driving circuit, under the control of a clock signal of a second-succeeding-stage gate driving circuit; and a pull-down maintaining module, used to maintain level of the output terminal of the pull-up control module and level of the scanning signal of the current-stage gate driving circuit both at a predetermined low level, under the control of the level of the output terminal of the pull-up control module and an external signal.

15 Claims, 2 Drawing Sheets

(56) References Cited

U.S. PATENT DOCUMENTS

| | | | | |
|---|---|---|---|---|
| 2018/0374442 | A1* | 12/2018 | Hao | G11C 19/28 |
| 2019/0012945 | A1* | 1/2019 | Xu | G09G 3/3677 |
| 2019/0012966 | A1* | 1/2019 | Shi | G09G 3/3266 |
| 2019/0019460 | A1* | 1/2019 | Shi | G09G 3/3677 |
| 2019/0019471 | A1* | 1/2019 | Zeng | G09G 3/20 |

* cited by examiner

GATE DRIVING CIRCUIT AND DRIVING METHOD THEREOF

CROSS-REFERENCE TO RELATED APPLICATIONS

The present application claims the priority of Chinese patent application CN 201710580980.0, entitled "Gate driving circuit and driving method thereof" and filed on Jul. 17, 2017, the entirety of which is incorporated herein by reference.

FIELD OF THE INVENTION

The present disclosure relates to the technical field of display control, and in particular, to a gate driving circuit and a driving method thereof.

BACKGROUND OF THE INVENTION

As flat panel display technology develops, it has become a trend to develop flat display panels with a high resolution, a high contrast, a high refresh rate, a narrow bezel, and a thin body. At present, liquid crystal display (LCD) panels are still a mainstream product of panel display. In order to realize narrow-bezel, thin, and cost-effective LCD panels, development and application of GOA (Gate Driver On Array) technology have become relatively mature.

In the prior art, generally speaking, reset of Q(n) node in a GOA circuit of a display panel can be realized only by means of a high-level scanning signal outputted by a gate driving circuit in a $G(n+2)^{th}$ stage. If the $G(n+2)^{th}$-stage gate driving circuit does not output the scanning signal normally, Q(n) node in an $n^{th}$ stage of the GOA circuit cannot be reset, which affects normal display of a next frame. Sometimes, the abnormality can also make a gate output a multiple-pulse waveform, which will then activate an over-current protection function and lead to an automatic shutdown of the device.

SUMMARY OF THE INVENTION

To solve the above problem, the present disclosure provides a gate driving circuit and a driving method thereof, so that abnormality of a control signal of a GOA circuit will not affect normal driving of a panel.

According to one aspect of the present disclosure, a gate driving circuit is provided. The gate driving circuit comprises a pull-up control module, a pull-up module, a pull-down module, and a pull-down maintaining module.

The pull-up control module is used to input a scanning signal of a second-previous-stage gate driving circuit under the control of a scanning-starting signal of the second-previous-stage gate driving circuit.

The pull-up module is used to input a clock signal under the control of the scanning signal of the second-previous-stage gate driving circuit which is outputted by the pull-up control module, so as to generate a scanning signal of a current-stage gate driving circuit.

The pull-down module is used to pull down level of an output terminal of the pull-up control module and level of the scanning signal of the current-stage gate driving circuit, under the control of a clock signal of a second-succeeding-stage gate driving circuit.

The pull-down maintaining module is used to maintain the level of the output terminal of the pull-up control module and the level of the scanning signal of the current-stage gate driving circuit both at a predetermined low level, under the control of the level of the output terminal of the pull-up control module and an external signal.

According to one embodiment of the present disclosure, the pull-up control module comprises a first transistor. A gate of the first transistor is used to input the scanning-starting signal of the second-previous-stage gate driving circuit, a source thereof is used to input the scanning signal of the second-previous-stage gate driving circuit, and a drain thereof is connected with the pull-up module.

According to one embodiment of the present disclosure, the pull-up module comprises a second transistor. A gate of the second transistor is connected with the drain of the first transistor, a source thereof is used to input a clock signal, and a drain thereof is used to output the scanning signal of the current-stage gate driving circuit.

According to one embodiment of the present disclosure, the pull-down module comprises a third transistor and a fourth transistor.

A gate of the third transistor is used to input the clock signal of the second-succeeding-stage gate driving circuit, a source thereof is connected with the drain of the second transistor, and a drain thereof is connected with the predetermined low level.

A gate of the fourth transistor is used to input the clock signal of the second-succeeding-stage gate driving circuit, a source thereof is connected with the gate of the second transistor, and a drain thereof is connected with the predetermined low level.

According to one embodiment of the present disclosure, the pull-down maintaining module comprises a first pull-down maintaining sub-module. The first pull-down maintaining sub-module comprises a fifth transistor, a sixth transistor, a seventh transistor, an eighth transistor, a ninth transistor, and a tenth transistor.

A gate of the fifth transistor is used to input a first external signal and a source thereof is connected with its gate.

A gate of the sixth transistor is connected with the output terminal of the pull-up control module, a source thereof is connected with the drain of the fifth transistor, and a drain thereof is connected with the predetermined low level.

A gate of the seventh transistor is connected with the drain of the fifth transistor and a source thereof is connected with the source of the fifth transistor. A gate of the eighth transistor is connected with the output terminal of the pull-up control module, a source thereof is connected with the drain of the seventh transistor, and a drain thereof is connected with the predetermined low level.

A gate of the ninth transistor is connected with the drain of the seventh transistor, a source thereof is connected with the output terminal of the pull-up control module, and a drain thereof is connected with the predetermined low level.

A gate of the tenth transistor is connected with the drain of the seventh transistor, a source thereof is connected with the output terminal of the pull-up module and connected with the output terminal of the pull-up control module by means of a coupling capacitor, and a drain thereof is connected with the predetermined low level.

According to one embodiment of the present disclosure, the pull-down maintaining module further comprises a second pull-down maintaining sub-module.

The second pull-down maintaining sub-module comprises an eleventh transistor, a twelfth transistor, a thirteenth transistor, a fourteenth transistor, a fifteenth transistor, and a sixteenth transistor.

A gate of the eleventh transistor is used to input a second external signal and a source thereof is connected with its gate. The second external control signal and the first external control signal are configured to alternately drive a corresponding pull-down maintaining module to work.

A gate of the twelfth transistor is connected with the output terminal of the pull-up control module, a source thereof is connected with the drain of the eleventh transistor, and a drain thereof is connected with the predetermined low level.

A gate of the thirteenth transistor is connected with the drain of the eleventh transistor and a source thereof is connected with the source of the eleventh transistor.

A gate of the fourteenth transistor is connected with the output terminal of the pull-up control module, a source thereof is connected with the drain of the thirteenth transistor, and a drain thereof is connected with the predetermined low level.

A gate of the fifteenth transistor is connected with the drain of the thirteenth transistor, a source thereof is connected with the output terminal of the pull-up control module, and a drain thereof is connected with the predetermined low level.

A gate of the sixteenth transistor is connected with the drain of the thirteenth transistor, a source thereof is connected with the output terminal of the pull-up module and connected with the output terminal of the pull-up control module by means of a coupling capacitor, and a drain thereof is connected with the predetermined low level.

According to one embodiment of the present disclosure, the circuit further comprises a reset module which comprises a seventeenth transistor.

A gate of the seventeenth transistor is used to input a reset signal, a source thereof is connected with the output terminal of the pull-up control module, and a drain thereof is connected with the predetermined low level.

According to one embodiment of the present disclosure, the circuit further comprises a scanning-starting signal generation module which comprises an eighteenth transistor.

A gate of the eighteenth transistor is connected with the output terminal of the pull-up control module, a source thereof is used to input the clock signal, and a drain thereof is used to generate the scanning-starting signal of the current-stage gate driving circuit.

According to one embodiment of the present disclosure, the clock signal comprises 8 square wave clock sub-signals which have a duty ratio of 1/4 and are out of phase with each other sequentially by 1/8 clock cycle.

According to another aspect of the present disclosure, a driving method of a gate driving circuit is also provided. The method comprises the following steps.

A scanning-starting signal of a second-previous-stage gate driving circuit is applied to a pull-up control module, so that a scanning signal of the second-previous-stage gate driving circuit is outputted by the pull-up control module.

A clock signal is outputted by the pull-up module under the control of the scanning signal of the second-previous-stage gate driving circuit outputted by the pull-up control module, so as to generate a scanning signal of the current-stage gate driving circuit.

A clock signal of a second-succeeding-stage gate driving circuit is applied to a pull-down module, so that level of an output terminal of the pull-up control module and level of the scanning signal of the current-stage gate driving circuit are pulled down to a predetermined low level.

An external signal is applied to a pull-down maintaining module, and in presence of the predetermined low level of the output terminal of the pull-up control module, level of the output terminal of the pull-up control module and level of the scanning signal of the current-stage gate driving circuit are both maintained at the predetermined low level.

The present disclosure achieves the following beneficial effects.

The present disclosure uses a clock signal CK, rather than a scanning signal, to pull down level of Q(n) node, so that abnormality of a control signal of a GOA circuit will not affect normal driving of a panel.

Other advantages, objectives, and features of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure or the prior art, and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no conflict, all the technical features mentioned in all the embodiments may be combined together in any manner, and the technical solutions obtained in this manner all fall within the scope of the present disclosure.

Figure 1:
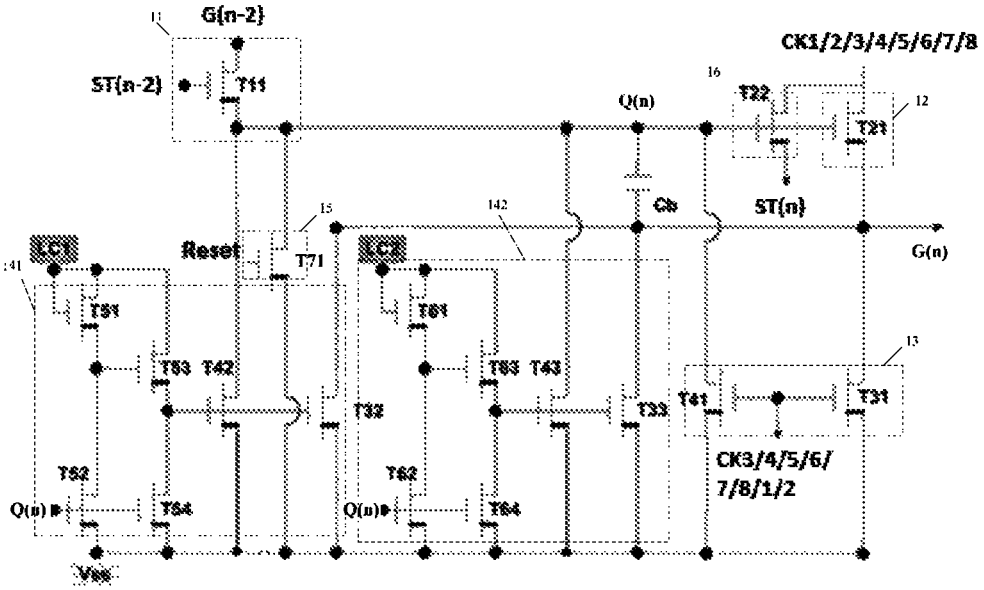
FIG. 1 schematically shows a structure of a gate driving circuit in one embodiment of the present disclosure.

The present disclosure provides a gate driving circuit, which uses a clock signal to pull down level of Q(n) node, so that abnormality of a scanning signal will not affect normal driving of a panel. FIG. 1 schematically shows a structure of a gate driving circuit in a $G(n)^{th}$ stage in one embodiment of the present disclosure. The present disclosure will be explained in details with reference to FIG. 1. Adjacent gate driving circuits in a $G(n-2)^{th}$ stage, in a $G(n)^{th}$ stage, and in a $G(n+2)^{th}$ stage are taken as an example. The gate driving circuits in the $G(n-2)^{th}$ stage, in the $G(n)^{th}$ stage, in the $G(n+2)^{th}$ stage, . . . , are used to drive gate lines in odd rows or in even rows, and each gate driving circuit outputs a corresponding scanning signal. Gate driving circuits in a $G(n-1)^{th}$ stage, in a $G(n+1)^{th}$ stage, in a $G(n+3)^{th}$ stage, . . . , are used to drive gate lines in even rows or in odd rows, and each gate driving circuit outputs a corresponding scanning signal.

As shown in FIG. 1, each gate driving circuit comprises a pull-up control module 11, a pull-up module 12, a pull-down module 13, and a pull-down maintaining module 14.

The pull-up control module 11 is used to input a scanning signal G(n−2) of a second-previous-stage gate driving circuit (i.e. a gate driving circuit before a previous-stage gate driving circuit), under the control of a scanning-starting signal ST(n−2) of the second-previous-stage gate driving circuit. In other words, the $G(n)^{th}$-stage gate driving circuit is configured to start working under the control of the $G(n-2)^{th}$-stage gate driving circuit. An output terminal of the pull-up control module 11 is generally marked as a Q(n) node, and the pull-up control module 11 is mainly used to output the scanning signal G(n−2) of the second-previous-stage gate driving circuit to the Q(n) node under the control of the signal ST(n−2).

The pull-up module 12 is configured to input a clock signal CK under the control of the scanning signal G(n−2) of the second-previous-stage gate driving circuit which is outputted by the pull-up control module 11 to the Q(n) node, so as to generate a scanning signal G(n) of a current-stage gate driving circuit.

Figure 3:
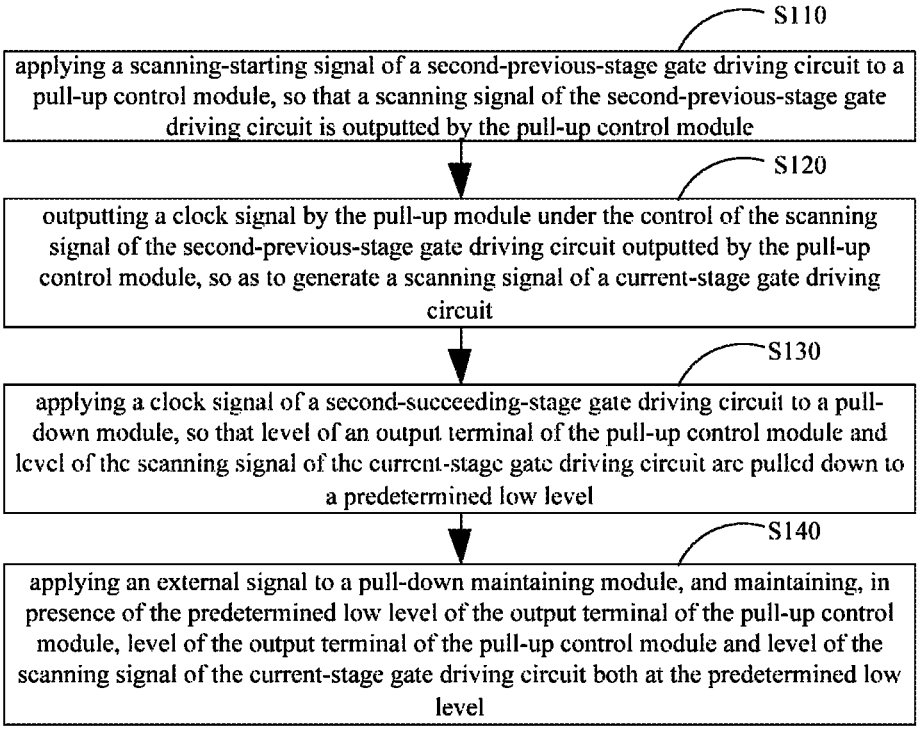
FIG. 3 schematically shows a flow diagram of a method of driving the circuit in FIG. 1 in one embodiment of the present disclosure.

The pull-down module 13 is used to pull down level of the output terminal of the pull-up control module 11 and level of the scanning signal G(n) of the current-stage gate driving circuit, under the control of a clock signal CK (n+2) of a second-succeeding-stage gate driving circuit (i.e. a gate driving circuit following a next-stage gate driving circuit). As shown in FIG. 3, while outputting the scanning signal G(n), the pull-up module 12 inputs a clock signal CK1. At that time, the pull-down module 13 is controlled by a clock signal CK3. While the pull-up module 12 inputs a clock signal CK2, the pull-down module 13 is controlled by a clock signal CK4. Likewise, the rest goes in the same manner. While the pull-up module 12 inputs a clock signal CK7 and a clock signal CK8, go back to the starting, that is, the pull-down module 13 is controlled by the clock signal CK1 and a clock signal CK2.

The pull-down maintaining module 14 is used to maintain the level of the output terminal of the pull-up control module 11 and the level of the scanning signal G(n) of the current-stage gate driving circuit both at a predetermined low level Vss, under the control of the level of the output terminal of the pull-up control module 11 and an external signal LC. In other words, after the pull-down module 13 pulls down the level of the output terminal of the pull-up control module 11 and the level of the scanning signal of the current-stage gate driving circuit to the predetermined low level Vss, the pull-down maintaining module 14 maintains the level of the output terminal of the pull-up control module 11 and the level of the scanning signal of the current-stage gate driving circuit both at the predetermined low level Vss, under the control of the level of the output terminal of the pull-up control module 11 and the external signal LC.

In the present disclosure, the pull-down module 13 of the gate driving circuit is controlled by the clock signal CK (n+2) of the second-succeeding-stage gate driving circuit, instead of the signal G(n+2), so that when output of the signal G(n+2) is abnormal, the level of Q(n) node is pulled down by the clock signal CK. Even if the signal G(n+2) is abnormal, the gate driving circuit can still work normally when a next frame refreshes.

In one embodiment of the present disclosure, the pull-up control module 11 comprises a first transistor T11. A gate of the first transistor T11 is used to input a scanning-starting signal CK(n−2) of the second-previous-stage gate driving circuit, a source thereof is used to input the scanning signal G(n−2) of the second-previous-stage gate driving circuit, and a drain thereof is connected with the pull-up module 12. During working, the scanning-starting signal ST(n−2) outputted by the $G(n-2)^{th}$-stage gate driving circuit turns on the first transistor T11 and the scanning signal G(n−2) outputted by the $G(n-2)^{th}$-stage gate driving circuit arrives at the pull-up module through the first transistor T11, so as to control the pull-up module 12 to generate the scanning signal G(n) of the current-stage gate driving circuit.

In one embodiment of the present disclosure, the pull-up module 12 comprises a second transistor T21. A gate of the second transistor T21 is connected with the drain of the first transistor T11, a source thereof is used to input the clock signal CK, and a drain thereof is used to output the scanning signal G(n) of the current-stage gate driving circuit. During working, the scanning-starting signal ST(n−2) outputted by the pull-up control module 11 turns on the second transistor T21 and the clock signal CK is outputted by the source of the second transistor T21 to the drain, so as to generate the scanning signal G(n) of the current-stage gate driving circuit.

In one embodiment of the present disclosure, the pull-down module 13 comprises a third transistor T31 and a fourth transistor T41. A gate of the third transistor T31 is used to input the clock signal CK of the second-succeeding-stage gate driving circuit, a source thereof is connected with the drain of the second transistor T21, and a drain thereof is connected with the predetermined low level Vss.

A gate of the fourth transistor T41 is used to input the clock signal CK of the second-succeeding-stage gate driving circuit, a source thereof is connected with the gate of the second transistor T21, and a drain thereof is connected with the predetermined low level Vss. During working, while the clock signal CK of the second-succeeding-stage gate driving circuit is at a high level, the third transistor T31 and the fourth transistor T41 are both turned on. The predetermined low level Vss is in communication with the output terminal of the pull-up control module 11 through the third transistor T31 and in communication with the output terminal of the pull-up module 12 through the fourth transistor T41, so that the level of Q(n) node and the level of the scanning signal G(n) are pulled down to the predetermined low level Vss.

The clock signal CK of the second-succeeding-stage gate driving circuit is at a high level only when the current-stage gate driving circuit is outputting a scanning signal; at other times, the clock signal CK is at a low level. To ensure that the level of Q(n) node and the level of the scanning signal G(n) are maintained at the predetermined low level while the current-stage gate driving circuit is not outputting a scanning signal, a pull-down maintaining module is required. In one embodiment of the present disclosure, the pull-down maintaining module 14 comprises a first pull-down maintaining sub-module 141. The first pull-down maintaining sub-module 141 comprises a fifth transistor T51, a sixth transistor T52, a seventh transistor T53, an eighth transistor T54, a ninth transistor T42, and a tenth transistor T32. A gate of the fifth transistor T51 is used to input a first external signal LC1 and a source thereof is connected with its gate. A gate of the sixth transistor T52 is connected with the output terminal of the pull-up control module 11, a source thereof is connected with the drain of the fifth transistor T51, and a drain thereof is connected with the predetermined low level Vss. A gate of the seventh transistor T53 is connected with the drain of the fifth transistor T51 and a source thereof is connected with the source of the fifth transistor T51. A gate of the eighth transistor T54 is connected with the output terminal of the pull-up control module 11, a source thereof is connected with the drain of the seventh transistor T53, and a drain thereof is connected with the predetermined low level Vss. A gate of the ninth transistor T42 is connected with the drain of the seventh transistor T53, a source thereof is connected with the output terminal of the pull-up control module 11, and a drain thereof is connected with the predetermined low level Vss. A gate of the tenth transistor T32 is connected with the drain of the seventh transistor T53, a source thereof is connected with the output terminal of the pull-up module 12 and connected with the output terminal of the pull-up control module 11 by means of a coupling capacitor Cb, and a drain thereof is connected with the predetermined low level Vss.

Specifically, while the scanning signal G(3) is being outputted, the high-level scanning signal G(3) pulls down the level of Q(1) node and the level of G(1) node to Vss. At that moment, the sixth transistor T52 and the eighth transistor T54 are turned off. The high-level first external signal LC1 is applied and the fifth transistor T51 and the seventh transistor T53 are turned on. Then the ninth transistor T42 is turned on and Q(1) node is connected to the predetermined low level Vss; the tenth transistor T32 is turned on and G(1) node is connected to the predetermined low level Vss. By way of this, Q(1) node and G(1) node can be maintained at the predetermined low level, until a high-level scanning signal G(1) is outputted. In addition, while the high-level scanning signal G(1) is outputted, the sixth transistor T52 and the eighth transistor T54 are turned on, so that the ninth transistor T42 and the tenth transistor T32 are turned off and the first pull-down maintaining sub-module 141 is not able to work.

In one embodiment of the present disclosure, the pull-down maintaining module 14 comprises a second pull-down maintaining sub-module 142. The second pull-down maintaining sub-module 142 comprises an eleventh transistor T61, a twelfth transistor T62, a thirteenth transistor T63, a fourteenth transistor T64, a fifteenth transistor T43, and a sixteenth transistor T33. A gate of the eleventh transistor T61 is used to input a second external signal LC2, and a source thereof is connected with its gate. The second external signal LC2 and the first external signal LC1 alternately drive a corresponding pull-down maintaining module to work. A gate of the twelfth transistor T62 is connected with the output terminal of the pull-up control module 11, a source thereof is connected with the drain of the eleventh transistor T51, and a drain thereof is connected with the predetermined low level Vss. A gate of the thirteenth transistor T63 is connected with the drain of the eleventh transistor T51 and a source thereof is connected with the source of the eleventh transistor T51. A gate of the fourteenth transistor T64 is connected with the output terminal of the pull-up control module 12, a source thereof is connected with the drain of the thirteenth transistor T63, and a drain thereof is connected with the predetermined low level Vss. A gate of the fifteenth transistor T43 is connected with the drain of the thirteenth transistor T63, a source thereof is connected with the output terminal of the pull-up control module 11, and a drain thereof is connected with the predetermined low level Vss. A gate of the sixteenth transistor T33 is connected with the drain of the thirteenth transistor T63, a source thereof is connected with the output terminal of the pull-up module 12 and connected with the output terminal of the pull-up control module 11 by means of a coupling capacitor Cb, and a drain thereof is connected with the predetermined low level Vss. The first external signal LC1 and the second external signal LC2 are low-frequency signals with a period that is 200 times a length of a frame period and a duty ratio of 1/2 . The first external signal LC1 and the second external signal LC2 are out of phase by 1/2 period. The first external signal LC1 drives the first pull-down maintaining sub-module 141 and the second external signal LC2 drives the second pull-down maintaining sub-module 142. The first pull-down maintaining sub-module 141 and the second pull-down maintaining sub-module 142 work alternatively. The second pull-down maintaining sub-module 142 works in the same way as the first pull-down maintaining sub-module 141 and thus its course of work will not be elaborated here.

In one embodiment of the present disclosure, the gate driving circuit further comprises a reset module 15. The reset module 15 comprises a seventeenth transistor T71. A gate of the seventeenth transistor T71 is used to input a reset signal, a source thereof is connected with the output terminal of the pull-up control module 11, and a drain thereof is connected with the predetermined low level Vss. The seventeenth transistor T71 is used to reset level of Q(n) node when an external control signal Reset is applied.

In one embodiment of the present disclosure, the gate driving circuit further comprises a scanning-starting signal generation module 16. The scanning-starting signal generation module 16 comprises an eighteenth transistor T22. A gate of the eighteenth transistor T22 is connected with the output terminal of the pull-up control module 11, a source thereof is used to input the clock signal CK, and a drain thereof is used to output the scanning-starting signal ST(n) of the current-stage gate driving circuit.

Figure 2:
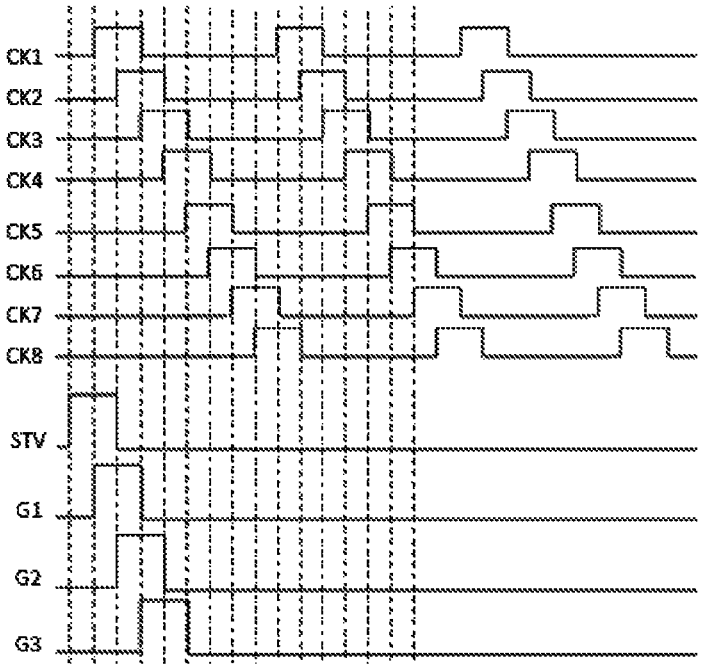
FIG. 2 schematically shows a timing sequence of output of the gate driving circuit in FIG. 1.

In the prior art, a gate driving circuit generally adopts 4 square wave clock sub-signals with a duty ratio of 1/2 . In the present disclosure, a gate driving circuit adopts a clock signal comprising 8 square wave clock sub-signals that have a duty ratio of 1/4 and are out of phase with each other sequentially by 1/8 clock period, as shown in FIG. 2. By way of this, the load of each CK line and risks of wrong charge can be reduced. In the meanwhile, choosing a square wave signal to pull down can increase dependence of a thin-film transistor in the pull-down module and lengthen its working life. In addition, choosing a square wave signal CK to pull down the level of Q(n) node can increase the anti-jamming ability of signals, so that a next frame will not be affected by abnormal output of one signal at one moment.

According to another aspect of the present disclosure, a driving method of the gate driving circuit is provided. The method comprises the following steps, as shown in FIG. 3. Its corresponding time sequence diagram is as shown in FIG. 2.

Firstly, in step S110, a scanning-starting signal of a second-previous-stage gate driving circuit is applied to a pull-up control module 11, so that a scanning signal of the second-previous-stage gate driving circuit is outputted by the pull-up control module 11. As for a G1(1)$^{th}$-stage gate driving circuit, since there is no scanning-starting signal of the second-previous-stage gate driving circuit, a starting signal STV is usually applied to start the G1(1)$^{th}$-stage gate driving circuit.

Then, in step S120, a pull-up module 12, under the control of the scanning signal of the second-previous-stage gate driving circuit outputted by the pull-up control module 11, outputs a clock signal, so that a scanning signal of a current-stage gate driving circuit is generated.

Next, in step S130, a clock signal of a second-succeeding-stage gate driving circuit is applied to a pull-down module 13, so that level of an output terminal of the pull-up control module and level of the scanning signal of the current-stage gate driving circuit are pulled down to a predetermined low level.

Lastly, in step S140, an external signal is applied to a pull-down maintaining module 14 and in presence of the predetermined low level of the output terminal of the pull-up control module 11, level of the output terminal of the pull-up control module 22 and level of the scanning signal of the current-stage gate driving circuit are both maintained at the predetermined low level.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A gate driving circuit, comprising:

a pull-up control module, used to input a scanning signal of a second-previous-stage gate driving circuit under the control of a scanning-starting signal of the second-previous-stage gate driving circuit;

a pull-up module, used to input a clock signal under the control of the scanning signal of the second-previous-stage gate driving circuit which is outputted by the pull-up control module, so as to generate a scanning signal of a current-stage gate driving circuit;

a pull-down module, used to pull down level of an output terminal of the pull-up control module and level of the scanning signal of the current-stage gate driving circuit, under the control of a clock signal of a second-succeeding-stage gate driving circuit; and a pull-down maintaining module, used to maintain the level of the output terminal of the pull-up control module and the level of the scanning signal of the current-stage gate driving circuit both at a predetermined low level, under the control of the level of the output terminal of the pull-up control module and an external signal.

2. The circuit according to claim 1, wherein the pull-up control module comprises:

a first transistor, its gate used to input the scanning-starting signal of the second-previous-stage gate driving circuit, its source used to input the scanning signal of the second-previous-stage gate driving circuit, and its drain connected with the pull-up module.

3. The circuit according to claim 2, wherein the pull-up module comprises:

a second transistor, its gate connected with the drain of the first transistor, its source used to input the clock signal, and its drain used to output the scanning signal of the current-stage gate driving circuit.

4. The circuit according to claim 3, wherein the pull-down module comprises:

a third transistor, its gate used to input the clock signal of the second-succeeding-stage gate driving circuit, its source connected with the drain of the second transistor, and its drain connected with the predetermined low level; and a fourth transistor, its gate used to input the clock signal of the second-succeeding-stage gate driving circuit, its source connected with the gate of the second transistor, and its drain connected with the predetermined low level.

5. The circuit according to claim 4, further comprising a reset module, wherein the reset module comprises:

a seventeenth transistor, its gate used to input a reset signal, its source connected with the output terminal of the pull-up control module, and its drain connected with the predetermined low level.

6. The circuit according to claim 3, wherein the pull-down maintaining module comprises a first pull-down maintaining sub-module, wherein the first pull-down maintaining sub-module comprises:

a fifth transistor, its gate used to input a first external signal and its source connected with its gate;

a sixth transistor, its gate connected with the output terminal of the pull-up control module, its source connected with the drain of the fifth transistor, and its drain connected with the predetermined low level;

a seventh transistor, its gate connected with the drain of the fifth transistor and its source connected with the source of the fifth transistor;

an eighth transistor, its gate connected with the output terminal of the pull-up control module, its source connected with the drain of the seventh transistor, and its drain connected with the predetermined low level;

a ninth transistor, its gate connected with the drain of the seventh transistor, its source connected with the output terminal of the pull-up control module, and its drain connected with the predetermined low level; and a tenth transistor, its gate connected with the drain of the seventh transistor, its source connected with an output terminal of the pull-up module and connected with the output terminal of the pull-up control module by means of a coupling capacitor, and its drain connected with the predetermined low level.

7. The circuit according to claim 6, wherein the pull-down maintaining module further comprises a second pull-down maintaining sub-module, wherein the second pull-down maintaining sub-module comprises:

an eleventh transistor, its gate used to input a second external signal and its source connected with its gate, wherein the second external signal and the first external signal are configured to alternately drive a corresponding pull-down maintaining sub-module to work;

a twelfth transistor, its gate connected with the output terminal of the pull-up control module, its source connected with the drain of the eleventh transistor, and its drain connected with the predetermined low level;

a thirteenth transistor, its gate connected with the drain of the eleventh transistor and its source connected with the source of the eleventh transistor;

a fourteenth transistor, its gate connected with the output terminal of the pull-up control module, its source connected with the drain of the thirteenth transistor, and its drain connected with the predetermined low level;

a fifteenth transistor, its gate connected with the drain of the thirteenth transistor, its source connected with the output terminal of the pull-up control module, and its drain connected with the predetermined low level; and a sixteenth transistor, its gate connected with the drain of the thirteenth transistor, its source connected with the output terminal of the pull-up module and connected with the output terminal of the pull-up control module by means of the coupling capacitor, and its drain connected with the predetermined low level.

8. The circuit according to claim 7, further comprising a reset module, wherein the reset module comprises:

a seventeenth transistor, its gate used to input a reset signal, its source connected with the output terminal of the pull-up control module, and its drain connected with the predetermined low level.

9. The circuit according to claim 6, further comprising a reset module, wherein the reset module comprises:

a seventeenth transistor, its gate used to input a reset signal, its source connected with the output terminal of the pull-up control module, and its drain connected with the predetermined low level.

10. The circuit according to claim 3, further comprising a reset module, wherein the reset module comprises:

a seventeenth transistor, its gate used to input a reset signal, its source connected with the output terminal of the pull-up control module, and its drain connected with the predetermined low level.

11. The circuit according to claim 2, further comprising a reset module, wherein the reset module comprises:

a seventeenth transistor, its gate used to input a reset signal, its source connected with the output terminal of the pull-up control module, and its drain connected with the predetermined low level.

12. The circuit according to claim 1, further comprising a reset module, wherein the reset module comprises:

a seventeenth transistor, its gate used to input a reset signal, its source connected with the output terminal of the pull-up control module, and its drain connected with the predetermined low level.

13. The circuit according to claim 1, further comprising a scanning-starting signal generation module, wherein the scanning-starting signal generation module comprises:

an eighteenth transistor, its gate connected with the output terminal of the pull-up control module, its source used to input the clock signal, and its drain used to generate the scanning-starting signal of the current-stage gate driving circuit.

14. The circuit according to claim 1, wherein the clock signal comprises 8 square wave clock sub-signals which have a duty ratio of 1/4 and are out of phase with each other sequentially by 1/8 clock cycle.

15. A driving method of a gate driving circuit, wherein the gate driving circuit comprises:

a pull-up control module, used to input a scanning signal of a second-previous-stage gate driving circuit under the control of a scanning-starting signal of the second-previous-stage gate driving circuit;

a pull-up module, used to input a clock signal under the control of the scanning signal of the second-previous-stage gate driving circuit which is outputted by the pull-up control module, so as to generate a scanning signal of a current-stage gate driving circuit;

a pull-down module, used to pull down level of an output terminal of the pull-up control module and level of the scanning signal of the current-stage gate driving circuit, under the control of a clock signal of a second-succeeding-stage gate driving circuit: and a pull-down maintaining module, used to maintain the level of the output terminal of the pull-up control module and the level of the scanning signal of the current-stage gate driving circuit both at a predetermined low level, under the control of the level of the output terminal of the pull-up control module and an external signal; and wherein the driving method comprises steps of:

applying the scanning-starting signal of the second-previous-stage gate driving circuit to the pull-up control module, so that the scanning signal of the second-previous-stage gate driving circuit is outputted by the pull-up control module;

outputting the clock signal by the pull-up module under the control of the scanning signal of the second-previous-stage gate driving circuit outputted by the pull-up control module, so as to generate the scanning signal of the current-stage gate driving circuit:

applying the clock signal of the second-succeeding-stage gate driving circuit to the pull-down module, so that level of the output terminal of the pull-up control module and level of the scanning signal of the current-stage gate driving circuit are pulled down to the predetermined low level; and applying the external signal to the pull-down maintaining module, and maintaining, in presence of the predetermined low level of the output terminal of the pull-up control module, level of the output terminal of the pull-up control module and level of the scanning signal of the current-stage gate driving circuit both at the predetermined low level.

* * * * *